US006000257A

United States Patent [19]

Thomas

[11] Patent Number: 6,000,257

[45] Date of Patent: Dec. 14, 1999

[54] ELECTRIC LATCH MECHANISM WITH AN INTEGRAL AUXILIARY MECHANICAL RELEASE

[75] Inventor: Andrew Patrick Thomas, Dearborn, Mich.

[73] Assignee: Ford Global Technologies, Inc., Dearborn, Mich.

[21] Appl. No.: 09/042,194

[22] Filed: Mar. 13, 1998

[51] Int. Cl.[6] ..... E05B 47/00

[52] U.S. Cl. ..... 70/279.1; 70/264; 70/277; 292/201

[58] Field of Search ..... 70/262–264, 277, 70/279, 283; 292/201, 216, 336.3, DIG. 23, DIG. 27

[56] References Cited

U.S. PATENT DOCUMENTS

| | | | |
|---|---|---|---|
| 3,566,703 | 3/1971 | Van Noord . | |
| 4,395,064 | 7/1983 | Bellot et al. | 292/201 |
| 4,667,990 | 5/1987 | Quantz | 292/201 |
| 5,007,261 | 4/1991 | Quantz | 70/240 |
| 5,020,838 | 6/1991 | Fukumoto | 292/201 |
| 5,066,054 | 11/1991 | Ingenhoven | 292/201 |
| 5,078,436 | 1/1992 | Kleefeldt et al. | 292/201 |
| 5,309,745 | 5/1994 | Ursel et al. | 70/264 |
| 5,497,640 | 3/1996 | Kokuryo | 70/277 X |
| 5,497,641 | 3/1996 | Linde et al. | 70/277 X |
| 5,537,848 | 7/1996 | Grzanka et al. | 70/279.1 |
| 5,577,782 | 11/1996 | Johnson et al. | 292/DIG. 23 X |
| 5,802,894 | 9/1998 | Jahrsetz et al. | 70/264 |

*Primary Examiner*—Suzanne Dino Barrett
*Attorney, Agent, or Firm*—Steven A. Maynard

[57] ABSTRACT

An automotive vehicle electric door latch mechanism includes a striker, a catch, a pawl, a key actuatable lock cylinder lever, an electrically driven output gear, and a manually actuatable release lever. The catch has a striker receiving surface and a pawl engaging surface. The pawl has a pin projecting therefrom, a catch engaging surface, and a cam contacting surface, the pawl being pivotally movable from a biased, catch engaging position to a catch disengaging position. The key actuatable lock cylinder lever has a pin striking surface and is pivotally movable between a biased, neutral position and a pin striking, pawl pivoting, catch disengaging position. The electrically driven output gear has at least one cam that is electrically movable between a neutral position and a pawl contacting, pawl pivoting, catch disengaging position. The manually actuatable release lever has a pin contacting surface and is manually pivotally movable from a biased, neutral position to a pin contacting, pawl pivoting, catch disengaging position.

12 Claims, 2 Drawing Sheets

ELECTRIC LATCH MECHANISM WITH AN INTEGRAL AUXILIARY MECHANICAL RELEASE

BACKGROUND OF THE INVENTION

1. Field of the Invention

The present invention relates generally to an automotive electric latch mechanism. More particularly, the present invention relates to an integral auxiliary mechanical release for such a mechanism.

2. Disclosure Information

Keyless remote entry systems are currently used to lock and unlock doors as well as to remotely open the rear deck lid. The rear deck lid is held in a biased closed position by an electrically actuated latch mechanism. The rear deck lid mechanisms typically employ a striker, a catch, a pawl, a key actuated lever, and an electrical actuator. Ordinarily, the catch is disengaged from the striker by rotating the pawl from a catch engaging position to a catch disengaging position by key actuated or electrical means.

It is desired to provide a keyless remote entry system that also provides for electric actuation of the vehicle doors. A problem with current electric latch mechanisms used for rear deck lids, is that they do not provide the features necessary for vehicle door latch electric actuation. More specifically, electric door latch actuation requires the aforementioned deck lid features, as well as a manual interior latch actuator, an inner door handle for example, and a manual interior release deactivator. Manual interior release deactivation is desired in the case of rear child safety scenarios, for example.

It would therefore be desirable to provide an automotive vehicle door electric latch mechanism which not only provides electric as well as key cylinder lever actuation, but also provides for interior manual actuation as well as manual deactivation.

SUMMARY OF THE INVENTION

The present invention overcomes the disadvantages of the prior art approaches by providing an automotive vehicle electric door latch mechanism having a striker, a catch, a pawl, a key actuatable lock cylinder lever, an electrically driven output gear, and a manually actuatable release lever. The catch has a striker receiving surface and a pawl engaging surface. The pawl has a pin projecting therefrom, a catch engaging surface, and a cam contacting surface, the pawl being pivotally movable from a biased, catch engaging position to a catch disengaging position. The key actuatable lock cylinder lever has a pin striking surface and is pivotally movable between a biased, neutral position and a pin striking, pawl pivoting, catch disengaging position. The electrically driven output gear has at least one cam that is electrically movable between a neutral position and a pawl contacting, pawl pivoting, catch disengaging position. The manually actuatable release lever has a pin contacting surface and is manually pivotally movable from a biased, neutral position to a pin contacting, pawl pivoting, catch disengaging position.

It is an object and advantage of the present invention that the latch mechanism has a manual release lever that may be actuated by an inside handle, manual release cable for example.

Another advantage of the present invention is that the manually actuatable release lever is pivotable to an inactive position thereby preventing manual actuation of the latch mechanism. This is advantageous in the case of child safety rear doors for example.

A further advantage of the present invention is that the manual release lever may be inactivated by the electrically driven output gear. The same output gear is utilized to electrically actuate the latch mechanism by engaging and pivoting the pawl out of engagement with the catch. Using a single output gear for electric as well as manual bypass functions saves on packaging space and mechanism cost.

These and other advantages, features and objects of the invention will become apparent from the drawings, detailed description and claims which follow.

DETAILED DESCRIPTION OF THE PREFERRED EMBODIMENTS

Figure 1:
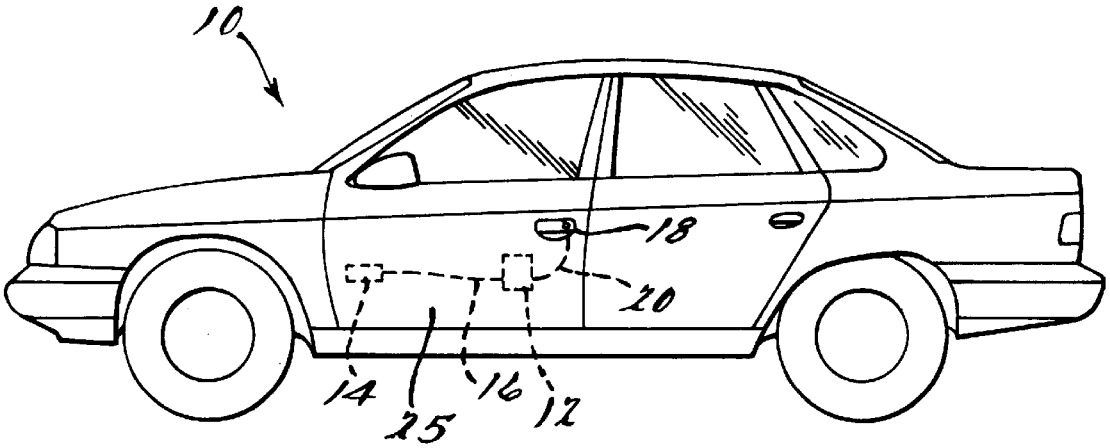
FIG. 1 is a side view of an automotive vehicle having an electric door latch mechanism according to the present invention.
Figure 2:
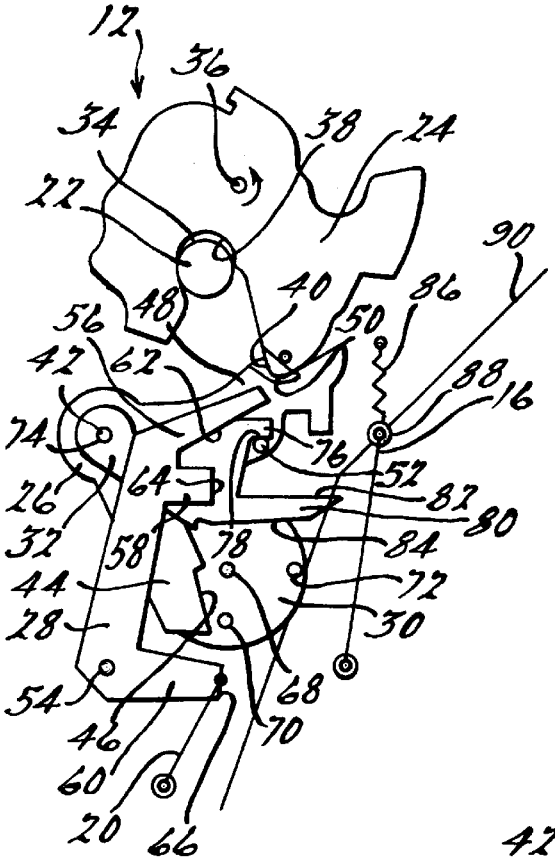
FIG. 2 is a side view of an electric door latch mechanism in a manually active, neutral position according to the present invention.

Referring now to the drawings, FIG. 1 shows an automotive vehicle 10 having an electric latch mechanism 12. The vehicle 10 is equipped with an inner release handle 14 with a release handle cable 16 operatively connecting the handle 14 to the latch mechanism 12. The vehicle 10 further has a key actuatable lock cylinder 18 with a lock cylinder cable 20 operatively connecting the cylinder 18 to the latch mechanism 12. As shown in FIG. 2, the latch mechanism 12, which engages a striker 22, has a catch 24, a pawl 26, a key actuatable lock cylinder lever 28, an electrically driven output gear 30, and a manually actuatable release lever 32. The latch mechanism 12 is preferably housed within a vehicle door 25.

As shown in FIG. 2, the striker 22 has a substantially circular cross section and a catch striking surface 34. The striker 22 is conventionally attached externally of the B pillar and is adapted to engage the catch 24 of the latch mechanism 12.

As further shown in FIG. 2, the catch 24 has a pivotal axis of rotation 36 about which the latching and unlatching function is performed. To facilitate this function the catch 24 has a substantially U-shaped striker receiving surface 38 and an elbow shaped portion having a pawl engaging surface 40.

As still shown in FIG. 2, the pawl 26 has a pivotal axis of rotation 42 about which a catch engaging—disengaging function is performed. Extending from the axis 42 is a first arm 44. The first arm 44 has a cam contacting surface 46. Also projecting from the axis 42 is a second arm 48, which is at a substantially ninety degree angle with respect to the first arm 44. The second arm 48 has a catch engaging surface 50 and a pin 52 projecting therefrom. The pin 52 is adapted to engage the lock cylinder lever 28 and the manual release lever 32, explained in further detail below.

As still further shown in FIG. 2, the key actuatable lock cylinder lever 28 has a pivotal axis of rotation 54 about which a pin striking, pawl pivoting, catch disengaging function is accomplished. The lever 28 has a substantially elongate body. An upper arm 56, an intermediate arm 58, and a lower arm 60, project essentially perpendicularly from the body. The upper arm 56 has a pin striking surface 62. The intermediate arm 58 has a cam striking surface 64. Lastly, the lower arm 60 has a lock cylinder cable attachment surface 66.

As also shown in FIG. 2, the output gear 30 is multidirectionally rotatable about an axis 68 and preferably has a first and second radially disposed, angularly displaced, cam, 70 and 72 respectively. In a first direction a pin contacting, pawl pivoting, catch disengaging function is performed. This function is performed via the first cam 70, which is adapted to contact the cam contacting surface 46 of the pawl first arm 44 when the output gear 30 is rotated in the first direction. In a second direction a release lever striking, release lever pivoting, release lever deactivating function is performed. This function is performed via the second cam 72, which is adapted to strike the release lever 32 when the output gear 30 is rotated in the second direction.

As also shown in FIG. 2, the manual release lever 32 has a pivotal axis 74 about which pin contacting, pawl pivoting, catch disengaging and release lever striking, release lever pivoting, release lever deactivating functions are accomplished. The release lever 32 has an upper arm 76 with a lower, pawl pin contacting, surface 78. The release lever 32 also has a lower arm 80 with an upper surface 82 and a lower, cam contacting, surface 84. The upper surface 82 is adapted to engage a manual release cable pin 88, explained in more detail below.

As further shown in FIG. 2, the lock cylinder lever 28 and manual release lever 32 may be actuated by conventional triggering means. More specifically, a lock cylinder lever cable 20 may operatively connect the lock cylinder 18 to the lock cylinder lever 28 at the lower arm attachment surface 66. A release handle cable 16 may operatively connect the inner release handle 14 to a release handle cable pin 88. The cable pin 88, neutrally positioned by a biasing member 86, is slidingly disposed in a slot 90. The cable pin 88 is adapted to contact the upper surface 82 of the lower arm 80 of the manual release lever 32 upon translation of the release handle cable 16.

With reference to FIGS. 2–6, the operational states, and component interactions, of the present latch mechanism 12 are described. As depicted in FIG. 2, the latch mechanism 12 is in a manually active, neutral latched state. More specifically, the striker 22 is engaged by the catch 24. Movement of the catch 24 is restricted by the catch engaging surface 50 of the pawl 26 being in contact with the pawl engaging surface 40 of the catch 24. The lock cylinder lever 28 is in a biased neutral position. In other words, the upper arm 56 is positioned to be brought into, but is not in contact with, the pawl pin 52. The upper arm lower surface 78 of the manual release lever 32 is in a biased, contacting relationship with the pawl pin 52. In this position, the release lever 32 is considered manually active in that, translating the release handle cable 16 would bring the cable pin 88 into contact with the release lever lower arm upper surface 82. Finally, the output gear 30 is in a biased, neutral position whereby the first and second cams, 70 and 72 respectively, are not contacting the pawl 26 nor the release lever 32.

Figure 3:
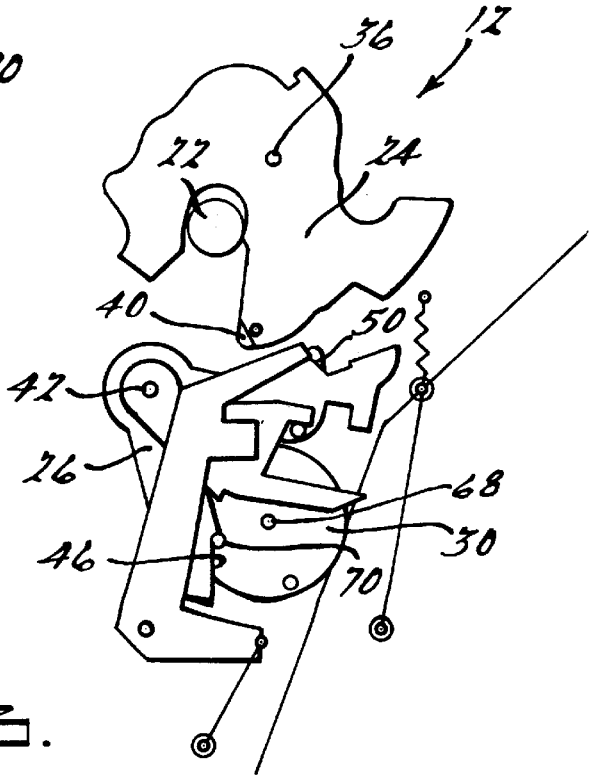
FIG. 3 is a side view of an electric door latch mechanism in an electrically actuated state according to the present invention.

As shown in FIG. 3, the latch mechanism 12 is in an electrically actuated position. More specifically, the output gear 30 is electrically rotated, about the output gear rotational axis 68, in the first direction bringing the first cam 70 into contact with the cam contacting surface 46 of the pawl 26. This contact pivotally displaces the pawl 26, about the pawl pivot axis 42, thereby disengaging the catch engaging surface 50 of the pawl 26 from the pawl engaging surface 40 of the catch 24. The catch 24 is thus free to rotate about the catch pivot axis 36, thus releasing the striker 22, thereby completing the unlatching function.

Figure 4:
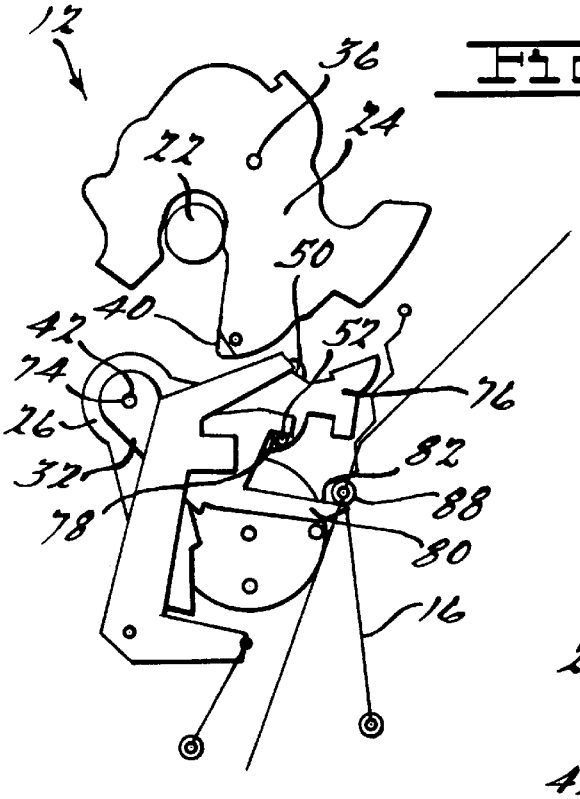
FIG. 4 is a side view of an electric door latch mechanism in an manually actuated state according to the present invention.

As shown in FIG. 4, the latch mechanism 12 is in a manually actuated position. More precisely, translation of the release handle cable 16 causes the cable pin 88 to contact the upper surface 82 of the lower arm 80 of the manual release lever 32. This contact pivotally displaces the release lever 32, about the release lever pivot axis 74. Pivotal displacement of the release lever 32, which is contacting the pawl pin 52 with the lower surface 78 of the upper arm 76, causes pivotal displacement of the pawl 26 about the pawl pivot axis 42. Pawl 26 displacement disengages the catch engaging surface 50 of the pawl 26 from the pawl engaging surface 40 of the catch 24. The catch 24 is thus free to rotate about the catch pivot axis 36, thus releasing the striker 22, thereby completing the unlatching function.

Figure 5:
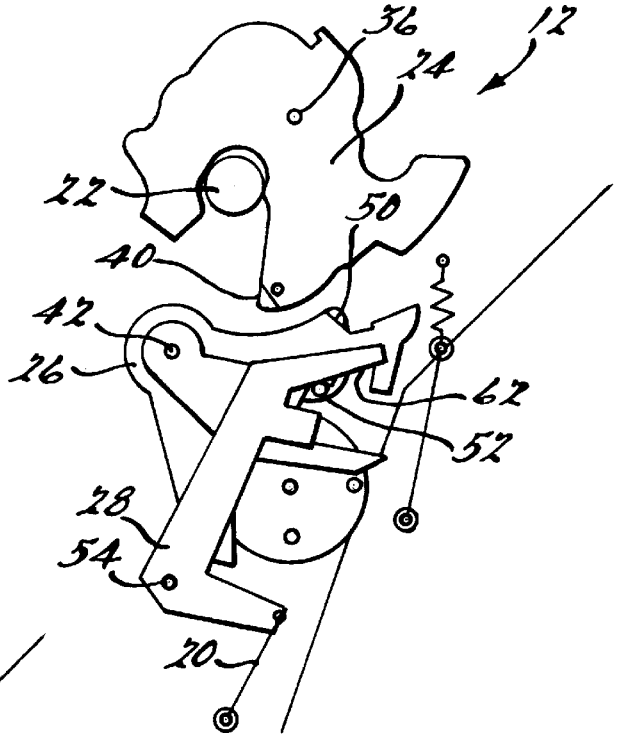
FIG. 5 is a side view of an electric door latch mechanism in a key lever actuated state according to the present invention.

As shown in FIG. 5, the latch mechanism 12 is in a key cylinder actuated position. More precisely, actuation of the key lock cylinder 18 causes translation of the lock cylinder cable 20. This translation pivotally displaces the lock cylinder lever 28, about the lock cylinder lever pivot axis 54. Pivotal displacement of the lock cylinder lever 28 causes the upper arm surface 62 to strike the pawl pin 52. Striking the pawl pin 52 in this fashion causes pivotal displacement of the pawl 26 about the pawl pivot axis 42. Pawl 26 displacement disengages the catch engaging surface 50 of the pawl 26 from the pawl engaging surface 40 of the catch 24. The catch 24 is thus free to rotate about the catch pivot axis 36, thus releasing the striker 22, thereby completing the unlatching function.

Figure 6:
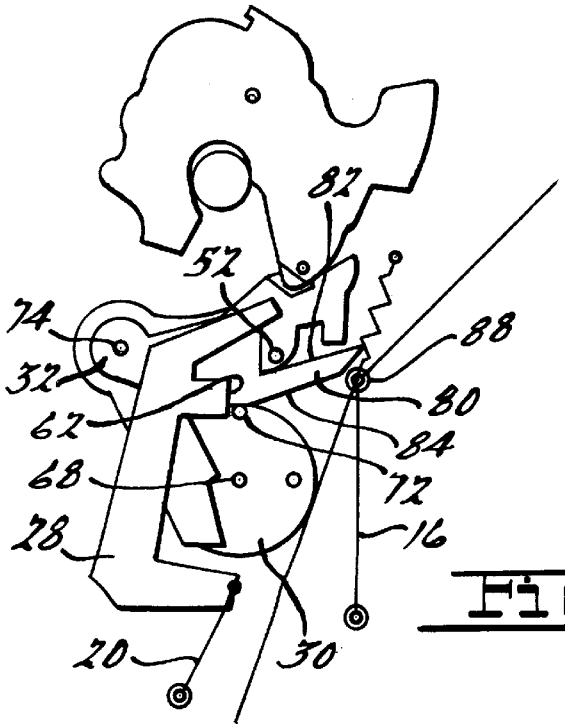
FIG. 6 is a side view of an electric door latch mechanism in a manually inactive, neutral state according to the present invention.

As shown in FIG. 6, the latch mechanism 12 is in a manually inactive, latched state. More specifically, the output gear 30 is electrically rotated, about the output gear rotational axis 68, in the second direction bringing the second cam 72 into contact with the lower arm lower surface 84 of the manual release lever 32. This contact pivotally displaces the release lever 32, about the release lever pivot axis 74, causing the lower arm upper surface 82 to contact the pawl pin 52. With the release lever 32 in this inactive position, translation of the release handle cable 16 causes the cable pin 88 to bypass the lower arm upper surface 82 of the manual release lever 32. Therefore, the latch mechanism 12 may not be activated in this state.

With further reference to FIG. 6, reactivating the manual release lever 32 may be accomplished one of two ways. First, actuating the key lock cylinder 18, in the above described fashion, causes the intermediate arm, cam striking surface 62 to displace the second cam 72. Displacing the second cam 72 in such a fashion returns the output gear 30 to the biased, neutral position. As a result, the manual release lever 32 is biasly returned to the upper arm pin contacting position, as well as actuating the latch mechanism 12 via the key cylinder lever 28, as described above. Secondly, the output gear 30 may be electrically rotated in the first direction, thereby placing the output gear 30 in the biased, neutral position and biasly returning the release lever 32 to the upper arm pin contacting position.

The present invention is advantageous for a number of reasons. First, the latch mechanism 12 has a manual release lever 32 that may be actuated by an inside handle, manual release cable 16 for example. This option is not provided in conventional latch mechanisms. Second, the manually actuatable release lever 32 is pivotable to an inactive position thereby preventing manual actuation of the latch mechanism 12. This is advantageous in the case of child safety rear doors for example. Third, the manual release lever 32 may be inactivated by the electrically driven output gear 30. The same output gear 30 is utilized to electrically actuate the latch mechanism 12 by engaging and pivoting the pawl 26 out engagement with the catch 24. Using a single output gear 32 for electric as wall as manual bypass functions saves on packaging space and mechanism cost.

Various other modifications to the present invention will, no doubt, occur to those skilled in the art to which the present invention pertains. It is the following claims, including all equivalents, which define the scope of the present invention.

What is claimed is:

1. An automotive vehicle electric door latch mechanism comprising:

a striker;

a catch having a striker receiving surface and a pawl engaging surface;

a pawl having a pin projecting therefrom, a catch engaging surface, and a cam contacting surface, the pawl engaging the catch in a biased, catch engaging position and pivotally movable to a catch disengaging position;

a key actuatable lock cylinder lever having a pin striking surface, the lock cylinder in a biased, neutral position and pivotally movable, to strike the pin, to a pin striking, pawl pivoting, catch disengaging position;

an electrically driven output gear having at least one cam, the cam in a neutral position and electrically movable, to contact the pawl, to a pawl contacting, pawl pivoting, catch disengaging position; and a manually actuatable release lever having a pin contacting surface, the release lever contacting the pin in a biased, neutral position and manually pivotally movable to a pin contacting, pawl pivoting, catch disengaging position.

2. An electric latch mechanism according to claim 1, wherein the manually actuatable release lever has an upper pin contacting arm and a lower arm with a cam striking surface and a release cable pin contacting surface.

3. An electric latch mechanism according to claim 2, further comprising:

a manual release cable;

a pin attached to the release cable having a lower arm contacting surface; and a slot slidingly receiving the pin and adapted to constrain the pin to a predetermined path of travel upon translating the release cable, whereby when the release lever is in the neutral position the pin contacts the lower arm pivotally moving the release lever from the neutral position to the catch disengaging position.

4. An electric latch mechanism according to claim 3, wherein the release lever is further pivotally movable to an inactive position whereby the lower arm is out of the path of travel of the pin thereby preventing manual actuation of the latch mechanism.

5. An electric latch mechanism claim 4, wherein the output gear cam is further electrically movable to a lower arm striking, release lever pivoting, release lever deactivating position.

6. An electric latch mechanism claim 5, wherein the output gear is further multidirectionally movable between a first pawl contacting, pawl pivoting, catch disengaging direction and a second lower arm striking, release lever pivoting, release lever deactivating direction.

7. An automotive vehicle electric door latch mechanism comprising:

a striker;

a catch having a striker receiving surface and a pawl engaging surface;

a pawl having a first arm and a second arm with a pin projecting therefrom and a catch engaging surface thereon, the pawl pivotally movable from a biased, catch engaging position to a catch disengaging position;

a key actuatable lock cylinder lever having a pin striking arm and pivotally movable between a biased, neutral position and a pin striking, pawl pivoting, catch disengaging position;

an electrically driven output gear having at least one cam, the cam electrically rotatable between a neutral position and a pawl first arm contacting, pawl pivoting, catch disengaging position; and a manually actuatable release lever having an upper arm pin contacting lower surface, the release lever manually pivotally movable from a biased, neutral position to a lower surface pin contacting, pawl pivoting, catch disengaging position.

8. An electric latch mechanism according to claim 7, wherein the manually actuatable release lever further has a lower arm with an lower cam striking surface and an upper release cable pin contacting surface.

9. An electric latch mechanism according to claim 8, further comprising:

a manual release cable;

a pin attached to the release cable having a lower arm contacting surface; and a slot slidingly receiving the pin and adapted to constrain the pin to a predetermined path of travel upon translating the release cable, whereby when the release lever is in the neutral position the translating pin contacts the lower arm upper surface, pivotally moving the release lever from the neutral position to the catch disengaging position.

10. An electric latch mechanism according to claim 9, wherein the release lever is further pivotally movable to an inactive position whereby the lower arm is out of the path of travel of the translating pin thereby preventing manual actuation of the latch mechanism.

11. An electric latch mechanism according to claim 10, wherein the output gear cam is further electrically rotatable to a lower arm lower surface striking, release lever pivoting, release lever deactivating position.

12. An electric latch mechanism according to claim 11, wherein the output gear is further multidirectionally movable between a first pawl first arm contacting, pawl pivoting, catch disengaging direction and a second lower arm lower surface striking, release lever pivoting, release lever deactivating direction.

* * * * *